US005736295A

United States Patent [19]

Dale et al.

[11] Patent Number: 5,736,295

[45] Date of Patent: Apr. 7, 1998

[54] PHOTOGRAPHIC HIGH CONTRAST SILVER HALIDE MATERIAL

[75] Inventors: Allison Hazel Caroline Dale; Roger Hugh Piggin, both of Rickmansworth, England

[73] Assignee: Eastman Kodak Company, Rochester, N.Y.

[21] Appl. No.: 694,354

[22] Filed: Aug. 8, 1996

[30] Foreign Application Priority Data

Aug. 10, 1995 [GB] United Kingdom ..... 9516369

[51] Int. Cl.[6] ..... G03C 1/12; G03C 1/295

[52] U.S. Cl. ..... 430/264; 430/414; 430/415; 430/416; 430/571

[58] Field of Search ..... 430/264, 571, 430/414, 416, 415, 230

[56] References Cited

U.S. PATENT DOCUMENTS

| | | | |
|---|---|---|---|
| 3,345,175 | 10/1967 | Hayakawa et al. | 96/76 |
| 4,746,593 | 5/1988 | Kitchin et al. | 430/264 |
| 4,957,849 | 9/1990 | Inoue et al. | 430/264 |
| 5,316,889 | 5/1994 | Sakai | 430/264 |
| 5,362,620 | 11/1994 | Lamotte et al. | 430/571 |
| 5,413,897 | 5/1995 | Van Rompoy et al. | 430/230 |
| 5,512,415 | 4/1996 | Dale et al. | 430/264 |
| 5,589,318 | 12/1996 | Dale et al. | 430/264 |

FOREIGN PATENT DOCUMENTS

| | | | |
|---|---|---|---|
| 0 349 274 | 1/1990 | European Pat. Off. | G03C 1/10 |
| 0 364 166 | 4/1990 | European Pat. Off. | G03C 1/043 |

OTHER PUBLICATIONS

The Journal of Photographic Science, Jan./Feb. 1975, vol. 23, No. 1, pp. 23–31, XP002017444, Beels and Claes "Additional Formation of Silver as a Result of an Infectious Development of Silver Halide Emulsions:

*Primary Examiner*—Richard L. Schilling
*Attorney, Agent, or Firm*—J. Lanny Tucker

[57] ABSTRACT

A density enhancing amine compound is incorporated into a silver halide element containing both spectrally sensitized and non-spectrally sensitized silver halide grains in the emulsion layer.

10 Claims, No Drawings

PHOTOGRAPHIC HIGH CONTRAST SILVER HALIDE MATERIAL

FIELD OF THE INVENTION

The invention relates to high contrast photographic silver halide materials and particularly to those of the graphic arts type.

BACKGROUND OF THE INVENTION

For many years the very high contrast photographic images needed in the graphic arts and printing industries were obtained by developing a 'lith' emulsion (usually high in silver chloride content) in a hydroquinone, low sulfite, 'lith' developer by the process known as infectious development. High contrasts were achieved. However, such low sulfite developers are inherently unstable and are particularly inappropriate for machine processing.

Machine processing of graphics materials achieved by the use of so called 'rapid access' high contrast materials that have a toe (lower scale) contrast below 3 and typically about 2, good process latitude and good process stability. Such materials are easy to use but this is at the expense of noticeably reduced dot quality. Hence, they are not suitable for users requiring the highest of dot qualities. These materials are, however, well accepted and widely used and are in daily use alongside nucleated products described immediately below.

To achieve the high image quality obtainable with lith processing and yet increase the stability of the process, emulsions containing nucleating agents, for example, hydrazides, have been used and processed high pH (about pH 11.5) developer with conventional amounts of sulfite, hydroquinone and possibly metol or a pyrazolidone.

A further improvement in the area of high contrast materials was the introduction of a lower pH process (below pH 11) using hydrazides active at this low pH together with the use of a contrast booster compound, for example, one of the boosters described in U.S. Pat. No. 5,316,889 or an amine booster as described in U.S. Pat. No. 4,947,354. The hydrazides proposed for use in such materials are described, for example, in U.S. Pat. No. 4,278,748, U.S. Pat. No. 4,031,127, U.S. Pat. No. 4,030,925 and U.S. Pat. No. 4,323,643 and in European Patent 0,333,435.

The use of incorporated nucleators, for example hydrazides, is not ideally desirable because the process sensitivity is still substantially worse than that obtainable in the rapid access process. This is because nucleation is a 2-phase process, an initial slow induction process followed by a rapid infectious development that will continue until all the silver is consumed or the coating is removed from the developer; hence the time of development and process activity must be controlled with great accuracy. In addition the mechanism of nucleation gives rise to chemical image spread that increases the size of exposed images and can give rise to spontaneous areas of density known as 'pepper fog'.

The infectious process phenomenon of 'co-development' [*The Journal of Photographic Science* (1973) 23 6] is defined as the tendency for unexposed silver halide grains with no latent image to develop if they are in the near vicinity of developing grains that are fogged. No spectral sensitization is described. The extent of the co-development reported has been insufficient to make this little more than an interesting observation.

We have, however, now discovered that when an image-wise exposed silver halide layer having both spectrally sensitized and non-spectrally sensitized silver halide grains, a high silver:gel ratio and containing an appropriate amine, its density can be enhanced by the co-development effect to give a substantial density gain enabling the production of a high contrast material which does not contain a nucleating agent.

The object of the present invention is to provide improved high contrast silver halide photographic materials that do not contain a nucleating agent which use less silver, gelatin and sensitizing dye to obtain, improved contrast/image quality, lower dye stain through reduced dye laydown and reduced cost.

SUMMARY OF THE INVENTION

According to the present invention there is provided a high contrast photographic material comprising a support bearing a silver halide emulsion layer and optionally an adjacent hydrophilic colloid layer, which material is free from nucleating agents and has a silver:gelatin ratio above 1, the emulsion layer comprising both silver halide grains that are spectrally sensitized and silver halide grains that are not spectrally sensitized, and the material containing a density enhancing amine compound in the emulsion layer or an adjacent hydrophilic colloid layer.

The preferred range of silver:gelatin ratio is 1 to 5, more preferably 1.5 to 3.5 and most preferably 2 to 3.

The present invention allows amplification of the image formed in the spectrally sensitized emulsion grains by the co-development of the non-spectrally sensitized grains in the presence of the density enhancing amine compound. This allows a reduction in the amount of sensitizing dye used as not all the image-forming grains need to be spectrally sensitized.

Since only a proportion of the silver halide grains are spectrally sensitized the substantially lower coated dye levels result in lower post process dye stain and lower product cost.

However, the use of substantially higher dye levels on the causer emulsion (only) allows higher product speeds without post process dye stain.

The use of a non-spectrally sensitized emulsion of finer grain size than the 'causer' and subsequently higher covering power will allow reductions in overall coated silver laydown.

Unlike the amplification seen with hydrazine-type nucleated development, the present amplification, process will allow the performance required by users, i.e., low process sensitivity, no chemical image spread and zero pepper fog, while giving improved contrast and image quality relative to the current rapid access materials.

Further the present invention enables the use of a stable developing solution which again provides low process sensitivity.

DETAILED DESCRIPTION OF THE INVENTION

The density enhancing amine compounds are amines which when incorporated into a silver halide material containing both spectrally sensitized and non-spectrally sensitized silver halide grains cause a higher density to be obtained under the conditions of development intended for the product.

In one embodiment of the invention the density enhancing compound is an amine that comprises at least one secondary or tertiary amino group, and has an n-octanol/water partition coefficient (log P) of at least one, preferably at least three, and most preferably at least four, log P being defined by the formula:

$$\log P = \log \frac{[X_{octanol}]}{[X_{water}]}$$

wherein X is the concentration of the amine compound.

Preferably such an amine compound contains within its structure a group comprised of at least three repeating ethyleneoxy units. Examples of such compounds are described in U.S. Pat. No. 4,975,354.

It is preferred that the ethyleneoxy units are directly attached to the nitrogen atom of a tertiary amino group.

Included within the scope of the density enhancing amine compounds that may be utilized in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amines are compounds having at least 20 carbon atoms.

In one embodiment the density enhancing amine compound has the general formula:

$$Y((X)_n\text{—A-B})_m$$

wherein

Y is a group that adsorbs to silver halide,

X is a bivalent linking group composed of hydrogen, carbon, nitrogen and sulfur atoms, B is an amino group that may be substituted, an ammonium group or a nitrogen-containing heterocyclic group, m is 1, 2 or 3 and n is 0 or 1, or the general formula:

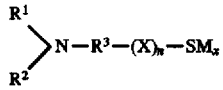

wherein $R^1$ and $R^2$ are each hydrogen or an aliphatic group, or $R^1$ and $R^2$ may together a ring, $R^3$ is a bivalent aliphatic group, X is a bivalent heterocyclic ring having at least one nitrogen, oxygen or sulfur atom as heteroatom, n is 0 or 1, and M is hydrogen or an alkali metal atom, alkaline earth metal atom, a quaternary ammonium, quaternary phosphonium atom or an amidino group, x is 1 when M is a divalent atom;

the compound optionally being in the form of an addition salt.

Preferred density enhancing amine compounds for the purposes of this invention are bis-tertiary-amines that have a partition coefficient of at least three and a structure represented by the formula:

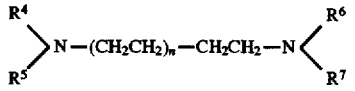

wherein n is an integer with a value of 3 to 50, and more preferably 10 to 50, $R^4$, $R^5$, $R^6$ and $R^7$ are, independently, alkyl groups of 1 to 8 carbon atoms, $R^4$ and $R^5$ taken together represent the atoms necessary to complete a heterocyclic ring, and $R^6$ and $R^7$ taken together represent the atoms necessary to complete a heterocyclic ring.

Another preferred group of density enhancing amine compounds are bis-secondary amines that have a partition coefficient of at least three and a structure represented by the formula:

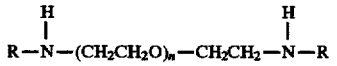

wherein n is an integer with a value of 3 to 50, and more preferably 10 to 50, and each R is, independently, a linear or branched, substituted or unsubstituted, alkyl group of at least 4 carbon atoms.

Particular amines suitable as density enhancers are listed in European Publication 364,166.

When the density enhancing amine compound is incorporated into the photographic material, it may be used in amounts of from 1 to 1000 mg/m$^2$, preferably from 10 to 500 mg/m$^2$ and, more preferably from 20 to 200 mg/m$^2$.

It is possible to locate the density enhancing amine compound in the developer rather than in the photographic material.

The spectrally sensitized grains can be silver bromoiodide, silver chlorobromoiodide, silver bromide, silver chloro-bromide, silver chloroiodide or silver chloride.

The non-spectrally sensitized grains can be independently, silver bromoiodide, silver chloroiodide, silver chlorobromoiodide, silver bromide, silver chlorobromide, or silver chloride.

Both types of grain may also contain dopants as more fully described below.

Preferably both the spectrally sensitized and the non-spectrally sensitized grains comprise at least 50 mole percent silver chloride, preferably from 50 to 90 mole percent silver chloride.

The size of the latent image-forming and non-latent image-forming grains preferably ranges independently between 0.05 and 1.0 μm in equivalent circle diameter, preferably 0.05 to 0.5 μm and most preferably 0.05 to 0.35 μm. The grain populations in the emulsion layer may have the same or differing grain sizes or morphologies.

In one embodiment of the present invention the grain size of the non-spectrally sensitized grains is smaller than that of the spectrally sensitized grains because, due to the covering power of small grains, the required density may be obtained with less silver halide.

As is known in the graphic arts field the silver halide grains may be doped with rhodium, ruthenium, iridium or other Group VIII metals either alone or in combination. The grains may be mono- or poly-disperse.

Preferably the silver halide grains are doped with one or more Group VIII metal at levels in the range $10^{-9}$ to $10^{-3}$, preferably $10^{-6}$ to $10^{-3}$, mole metal per mole of silver. The preferred Group VIII metals are rhodium and/or iridium.

In addition to graphic arts products the present materials may be black-and-white non-graphic arts photographic materials needing moderate contrasts, for example, microfilm and X-ray products.

The emulsions employed and the addenda added thereto, the binders, supports, etc. may be as described in *Research Disclosure* Item 308119, December 1989 published by Kenneth Mason Publications, Emsworth, Hants, United Kingdom.

The hydrophilic colloid may be gelatin or a gelatin derivative, polyvinylpyrrolidone or casein and may contain a polymer. Suitable hydrophilic colloids and vinyl polymers and copolymers are described in Section IX of *Research Disclosure* Item 308119, December 1989 published by Kenneth Mason Publications, Emsworth, Hants, United Kingdom. Gelatin is the preferred hydrophilic colloid.

The present photographic materials may also contain a supercoat hydrophilic colloid layer that may also contain a vinyl polymer or copolymer located as the last layer of the coating (furthest from the support). It may contain some form of matting agent.

The vinyl polymer or copolymer is preferably an acrylic polymer and preferably contains units derived from one or more alkyl or substituted alkyl acrylates or methacrylates, alkyl or substituted alkyl acrylamides or acrylates or acrylamides containing a sulfonic acid group.

The present emulsion layer is preferably formed by dye sensitizing an emulsion with a dye and then combining the spectrally sensitized emulsion with a non-spectrally sensitized emulsion. Preferably the sensitizing dye is chosen so that it does not become desorbed from said spectrally sensitized grains. The blending can be done immediately before coating but this is not necessary as the present blended emulsions are typically stable for at least 20 minutes at coating temperatures.

Two emulsion components can be used where the first component is a "causer" emulsion that is a normal, i.e., chemically and spectrally sensitized component, coated in the range 10 to 90% , preferably 30 to 50% by weight of the total silver laydown. The requirements for the second "receiver" emulsion component are that it be clean, i.e., free of fog, and be capable of being developed by the enhanced co-development process.

The lower dye laydown made possible by this invention is also particularly advantageous for systems that have been designed to run under low replenishment rate. Under normal replenishment rates (typically 300–600 ml/m$^2$ ) there is sufficient overflow of solution to carryout the build up of dye products released into the solution. If these dye products are not bleached by the chemistry then under low replenishment (300 ml/m$^2$ and below) the residual dye builds up to unacceptable levels causing dye stain on the materials being processed. This invention effectively eliminates or reduces this problem by removing the need for the usual amounts of dye. Having only the smaller fraction of the silver composed of a particular spectral sensitivity can often give rise to improvements in linearity of dot reproduction.

Where a particular spectral sensitization requires the use of compounds not necessary in the other emulsion components of the coating, the laydown of these compounds may be reduced. This reduction will lead to cost savings. These compounds may further have undesirable properties, such as high UV Dmin, and their effect can be reduced.

As the speed of the non-spectrally sensitized emulsion is not critical to the final photographic speed of the coated product this emulsion does not require chemical sensitization and thus the production of this component requires fewer steps in the manufacturing process and less stringent quality control leading to manufacturability and cost benefits.

As the maximum density of the material is not primarily dependent upon latent image-forming grains, the invention has the advantage that imaging emulsions of grain size above those used in standard high contrast coatings can be used without the need to increase the overall silver laydown.

The sensitizing dye may have one of the general formulae:

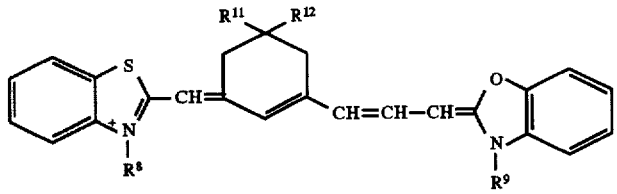

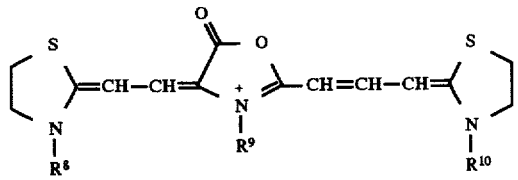

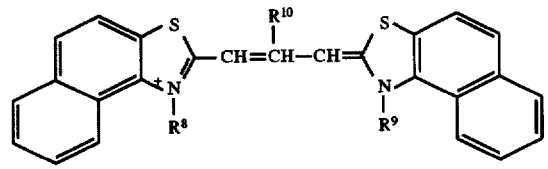

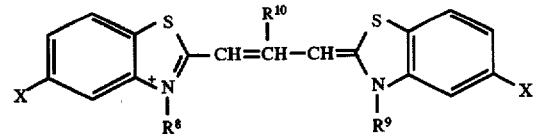

-continued

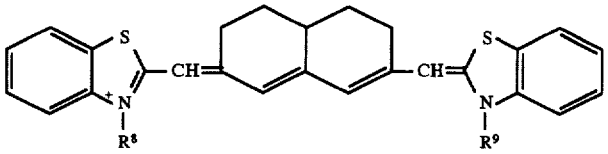

wherein $R^8$, $R^9$ and $R^{10}$ represent an alkyl group that may be substituted, for example, with an acid water-solubilizing group, for example, a carboxy or sulfo group, $R^{11}$ and $R^{12}$ are an alkyl group of 1–4 carbon atoms, and X is a halogen, for example, chloro, bromo, iodo or fluoro.

The present photographic materials preferably contain an antihalation layer on either side of the support. Preferably it is located on the opposite side of the support from the emulsion layer. In a preferred embodiment an antihalation dye is contained in the hydrophilic colloid underlayer. The dye may also be dissolved or dispersed in the underlayer. Suitable dyes are listed in our copending European application and in the *Research Disclosure* mentioned above.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images. When the photographic elements contain incorporated developing agents, the elements can be processed in the presence of an activator that can be identical to the developer in composition, but otherwise lacking a developing agent.

The developers are typically aqueous solutions, although organic solvents, such as diethylene glycol, can also be included to facilitate the solution of organic components. The developers contain one or a combination of conventional developing agents, such as a polyhydroxybenzene, aminophenol, paraphenylenediamine, ascorbic acid, pyrazolidone, pyrazolone, pyrimidine, dithionite, hydroxylamine or other conventional developing agents.

It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulfate can be incorporated into the developer. Chelating and sequestering agents, such as ethylenediaminetetraacetic acid or its sodium salt, can be present. Generally, any conventional developer composition can be employed in the practice of this invention. Specific illustrative photographic developers are disclosed in the *Handbook of Chemistry and Physics*, 36th Edition, under the title "Photographic Formulae" at page 3001 et seq. and in *Processing Chemicals and Formulas*, 6th Edition, published by Eastman Kodak Company (1963). The photographic elements can, of course, be processed with conventional developers for lithographic photographic elements, as illustrated by U.S. Pat. No. 3,573,914 and UK Patent No. 376,600.

The present photographic materials are particularly suitable for exposure by red or infra-red laser diodes, light emitting diodes or gas lasers, e.g., a Helium/Neon or Argon laser.

The following Examples are included for a better understanding of the invention.

EXAMPLE 1

A polyethylene terephthalate film support (with an antihalation pelloid layer) was coated with an emulsion layer consisting of a spectrally sensitized emulsion and a non-spectrally sensitized emulsion, an interlayer located between the emulsion and a protective supercoat.

The supercoat was a standard formula containing matte beads and surfactants and was coated at a gel laydown of 1.0 g/m$^2$.

The interlayer contained the amine density enhancer compound of the formula:

$$(C_3H_7)_2N(CH_2CH_2O)_{14}CH_2CH_2N(C_3H_7)_2 \quad (I)$$

and a latex copolymer and is coated at a gel level of 0.65 g/m$^2$.

The emulsion substrate used for the dyed and undyed components were the same in this example. It consisted of a 70:30 chlorobromide cubic monodispersed emulsion (0.18 μm edge length). A primitive sample omitting the chemical sensitization step was retained for use as Melt C. The remaining emulsion was suitably chemically sensitized with a 25 minute digestion at 65° C.

The dyed emulsion melt (Melt A) contained a sensitizing dye peaking in the 670 nm region, potassium iodide, a suitable anti-foggant package and latex copolymer.

The non-spectrally sensitized emulsion melt (Melt B) was prepared in the same way as melt A but the sensitizing dye was omitted. Melt C was prepared in a similar way to Melt B but contained the primitive non-chemically sensitized emulsion.

Coatings with and without an amine density enhancer in the interlayer were prepared having the emulsion layers indicated. The interlayer (where present) in each case contained the amine compound of formula 1 coated at 50 mg/m$^2$.

| Coating No. | Emulsion | Coating weight in g Ag/m$^2$ | Amine density enhancer |
|---|---|---|---|
| 1 | Melt A | 0.99 | No |
| | Melt C. | 2.31 | |
| 2 | Melt A | 0.99 | No |
| | Melt B | 2.31 | |
| 3 | Melt A | 0.99 | No |
| | Melt B | 1.32 | |
| | Melt C | 0.99 | |
| 4 | Melt A | 0.99 | Yes |
| | Melt C. | 2.31 | |
| 5 | Melt A | 0.99 | Yes |
| | Melt B | 2.31 | |
| 6 | Melt A | 0.99 | Yes |
| | Melt B | 1.32 | |
| | Melt C | 0.99 | |

The gelatin level of the emulsion layer was kept constant in all coatings at 1.4 g/m$^2$ giving a silver:gelatin ratio of 2.36 in each case.

In order to aid coating of these relatively low gelatin coatings a conventional thickening agent was added to increase melt viscosity and acceptable coating quality. In all cases the melts were kept separate from each other until they were mixed either in line immediately before the coating hopper or were mixed together and then coated within a very short period. This procedure is used to minimize any possibility of dye equilibration between the two components.

The above coatings were evaluated by exposing through a 0.1 increment step wedge with a $10^{-6}$ sec flash sensitometer fitted with a red light WRATTEN™ 29 filter and then processed in KODAK™ RA 2000 Developer (diluted 1+2) at 35° C. for 30 seconds. The amount of developed silver in the Dmax region was measured by X-ray fluorescence (XRF). The sensitometric and XRF results are shown below:

| Coating No. | Dmin | Dmax | Speed (at density = 0.6) | Toe Contrast | Developed Ag in Dmax g/m² |
|---|---|---|---|---|---|
| 1 | 0.026 | 1.26 | 1.02 | 2.04 | 0.93 |
| 2 | 0.024 | 1.22 | 1.00 | 1.95 | 0.89 |
| 3 | 0.023 | 1.20 | 0.98 | 1.96 | 0.89 |
| 4 | 0.025 | 2.55 | 1.14 | 2.46 | 1.72 |
| 5 | 0.024 | 2.53 | 1.14 | 2.50 | 1.72 |
| 6 | 0.024 | 2.47 | 1.12 | 2.43 | 1.70 |

Clearly a red light exposure has exposed a substantial proportion of the dyed causer emulsion in all coatings. In coatings 1, 2 and 3 the same Dmax from the similar causer coating laydown has given similar speed and Dmax despite the presence of either chemically sensitized or primitive undyed receiver emulsion. However the presence of the amine density enhancer compound in coatings 4, 5 and 6 clearly shows a substantial increase in Dmax such that for every grain exposed by red light another grain has been rendered developable during the development process effectively doubling the amount of developed silver with modest speed and toe contrast improvements.

EXAMPLE 2

The film coating of this invention consisted of a polyethylene terephthalate support (with an antihalation pelloid layer) on which was coated an emulsion layer consisting of a blend of a spectrally sensitized emulsion and a non-spectrally sensitized emulsion, an interlayer and a protective supercoat.

The supercoat was a standard formula containing matte beads and surfactants and was coated at a gel laydown of 1.0 g/m².

The interlayer contains latex copolymer and is coated at a gel level of 0.65 g/m².

Melt D consisted of a 70:30 chlorobromide cubic monodispersed emulsion (0.18 μm edge length). This emulsion was suitably chemically sensitized and had a 25 minute digestion at 65° C.

It was then spectrally sensitized using a dye peaking in the 670 nm region. Further additions to the melt included potassium iodide, a suitable anti-foggant package and latex copolymer.

Melt E was prepared in the same fashion as melt D but without the sensitizing dye.

A series of interlayers was prepared to provide a level series of the amine compound of formula I. These are described in the table below:

| Melt name | Laydown of amine (mg/m²) |
|---|---|
| Melt F | 0 |
| Melt G | 50 |
| Melt H | 100 |
| Melt I | 200 |

Coatings were prepared having an emulsion layer consisting of Melt D coated at a silver laydown of 0.66 g Ag/m² and Melt E coated at a silver laydown of 2.64 g Ag/m².

The overall gelatin laydown of the emulsion layer was 1.4 g/m² giving a silver:gelatin ration of 2.36. Above this common emulsion layer were coated the various interlayers.

The above coatings were evaluated by exposing through a 0.1 increment step wedge with a $10^{-6}$ sec flash sensitometer fitted with a red light WRATTEN™ 29 filter and then processed in KODAK™ 2000 Developer (diluted 1+2) at 35° C. for 30 seconds. This exposure forms latent image only in those grains that have been spectrally sensitized.

The table below shows the results from these coatings:

| Coating | Laydown of amine (mg/m²) | Dmax |
|---|---|---|
| 7 (comp.) | 0 | 1.62 |
| 8 | 50 | 3.34 |
| 9 | 100 | 4.01 |
| 10 | 200 | 3.95 |

Coating 7 exhibits the previously known phenomenon of co-development whereby a developing grain can cause extra density from nearby non-imaging grains by an infectious type process. Here, a coating containing only 0.66 g Ag/m² of the emulsion used in Melt D that would have a Dmax in the region of 1.1 [cf. coating 14 in Example 3], has shown a Dmax of 1.62. Conventional co-development is therefore giving approximately an extra 0.5 density units.

The invention is shown in coatings 8 to 10 that exhibit the novel phenomenon of an amine enhanced co-development delivering substantially higher levels of infectious amplification to give a density increase of almost 3.

EXAMPLE 3

Further coatings similar to Example 2 were prepared.

The supercoat was a standard formula containing matte beads and surfactants and was coated at a gel laydown of 1.0 g/m².

The underlayer contains latex copolymer and is coated at a gel level of 1.0 g/m². It contained the amine compound (formula I) at a level designed to give a coated laydown of 50 mg/m².

Melts J, K and L consisted of a 70:30 chlorobromide cubic monodispersed emulsion (0.18 μm edge length). This emulsion was suitably chemically sensitized and had a 25 minute digestion at 65° C.

It was then spectrally sensitized using a dye peaking in the 670 nm region. Further additions to the melt included potassium iodide, a suitable anti-foggant package and latex copolymer. The gelatin content of the three melts was such that when coated at a laydown of 0.66 g Ag/m² the gelatin laydown from the sensitized emulsion component was 0.245, 0.42 and 0.6 g/m² respectively.

Melts M, N and O were prepared in the same fashion as melts J, K, and L but without the sensitizing dye. The gelatin content of the three melts was such that when coated at a laydown of 2.64 g Ag/m$^2$ the gelatin laydown from the sensitized emulsion component was 0.979, 1.68 and 2.4 g/m$^2$ respectively.

Coatings were prepared having an emulsion layer consisting of 0.66 g/m$^2$ of spectrally sensitized emulsion (melts J, K and L) and 2.64g/m$^2$ of undyed emulsion (melts M, N and O). The overall gelatin laydown of the emulsion layer varied as shown in the table below:

| Coating | Imaging Ag (g/m$^2$) | Receiver Ag (g/m$^2$) | Total Ag (g/m$^2$) | Total gel (g/m$^2$) | Silver:gel ratio | Melts used in coating |
|---|---|---|---|---|---|---|
| 11 | 0.66 | 2.64 | 3.3 | 1.224 | 2.69 | J & M |
| 12 | 0.66 | 2.64 | 3.3 | 2.1 | 1.57 | K & N |
| 13 | 0.66 | 2.64 | 3.3 | 3.0 | 1.1 | L & O |
| 14 | 0.66 | 0 | 0.66 | 0.6 | 1.1 | L |

The above coatings were evaluated by exposing through a 0.1 increment step wedge with a $10^{-6}$ sec flash sensitometer fitted with a red light WRATTEN™ 29 filter and then processed in KODAK™ RA 2000 Developer (diluted 1+2) at 35° C. for 30 seconds. This exposure exposes only those grains that have been spectrally sensitized.

The table below shows the results from these coatings:

| Coating | Emulsion layer gelatin laydown (g/m$^2$) | Ag:gel ratio | Dmax | Density increase |
|---|---|---|---|---|
| 11 | 1.224 | 2.69 | 3.17 | 2.07 |
| 12 | 2.1 | 1.57 | 1.93 | 0.83 |
| 13 | 3.0 | 1.1 | 1.58 | 0.48 |
| 14 | 0.6 | 1.1 | 1.1 | 0 |

These coatings demonstrate the dependence of the enhanced co-development phenomenon on emulsion layer silver to gelatin laydown ratio.

EXAMPLE 4

A further coating was prepared in a manner similar to that of example 1.

The supercoat was a standard formula containing matte beads and surfactants and was coated at a gel laydown of 1.0 g/m$^2$.

The interlayer was coated at a gelatin laydown of 1.0 g/m$^2$ and it contained the amine compound (formula I) at a level designed to give a coated laydown of 60 mg/m$^2$.

The emulsion substrate used for the spectrally sensitized melt in this example consisted of a 70:30 chlorobromide cubic monodispersed emulsion (0.21 μm edge length). This emulsion was chemically sensitized with a 25 minute digestion at 65° C. The dyed emulsion melt (Melt P) contained a sensitizing dye peaking in the 670 nm region, potassium iodide, a suitable anti-foggant package and latex copolymer.

The emulsion substrate used for the non-spectrally sensitized melt in this example consisted of a 70:30 chlorobromide cubic monodispersed emulsion (0.13 μm edge length). This emulsion was not chemically sensitized. The non-spectrally sensitized emulsion melt (Melt Q) was prepared in the same way as Melt P but the sensitizing dye was omitted.

A coating (coating 15) was prepared having an emulsion layer consisting of 1.85 g/m2 of spectrally sensitized emulsion (melt P) and 1.65 g/m$^2$ of undyed emulsion (melt Q).

The control coating used in this example represents a typical rapid access material. It consists of an emulsion layer coated upon a polyethylene terephthalate film support (with an antihalation pelloid layer) and has a supercoat of standard formula. It also contains an interlayer having 0.65 g/m$^2$ of gelatin. There is no density enhancing amine compound added to this or any other layer of the control coating.

The emulsion layer of the control consists of a single 70:30 chlorobromide cubic monodispersed emulsion (0.21 μm edge length). This emulsion was suitably chemically and spectrally sensitized. The emulsion melt was prepared in a manner similar to that described above and was coated at a silver laydown of 4.0 g/m$^2$ and a gel level of 2.6 g/m$^2$.

Both coating 15 and the control comparison were evaluated by exposing using a laser diode sensitometer emitting in the 670 nm region that was modulated to produce a 0.12 log E increment step wedge and then processed in KODAK™ RA 2000 Developer (diluted 1+2) at 35° C. for 30 seconds. This exposure exposes only those grains that have been spectrally sensitized.

The table below shows the results from these coatings:

| Coating | Ag laydown (g/m$^2$) | Dmax | Speed (at density = 4) | Lower Scale Contrast | Covering Power (Dmax/Coated Ag) |
|---|---|---|---|---|---|
| 15 | 3.5 | 5.41 | 1.05 | 2.96 | 1.55 |
| control | 4.0 | 5.52 | 1.08 | 2.12 | 1.38 |

This example demonstrates that this invention can be used to reduce the silver laydown of a coating without compromising the maximum density. It also demonstrates improved contrast relative to a typical rapid access position.

The invention has been described in detail with particular reference to preferred embodiments thereof, but it will be understood that variations and modifications can be effected within the spirit and scope of the invention.

We claim:

1. A high contrast photographic material comprising a support bearing a silver halide emulsion layer and optionally an adjacent hydrophilic colloid layer, which material is free from nucleating agents and has a silver:gelatin ratio above 1, said emulsion layer comprising both silver halide grains that are spectrally sensitized and silver halide grains that are not spectrally sensitized, and said material containing a density enhancing amine compound in said emulsion layer or an adjacent hydrophilic colloid layer.

2. The material of claim 1 wherein said silver:gelatin ratio is in the range 1 to 5.

3. The photographic material of claim 1 wherein said density enhancing amine compound:

(a) comprises at least one secondary or tertiary amino group, and (b) has an n-octanol/water partition coefficient (log P) of at least one, log P being defined by the formula:

$$\log P = \log \frac{[X_{octanol}]}{[X_{water}]}$$

wherein X is the concentration of said density enhancing amine compound.

4. The photographic material of claim 3 wherein said density enhancing amine compound contains within its structure a group comprised of at least three repeating ethyleneoxy units.

5. The photographic material of claim 1 wherein said density enhancing amine compound has the general formula:

$$Y((X)_n—A—B)_m$$

wherein

Y is a group that adsorbs to silver halide,

X is a bivalent linking group composed of hydrogen, carbon, nitrogen and sulfur atoms, A is a bivalent linking group, B is an amino group that may be substituted, an ammonium group or a nitrogen-containing heterocyclic group, m is 1, 2 or 3 and n is 0 or 1, or the general formula:

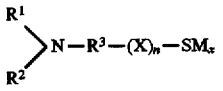

wherein $R^1$ and $R^2$ are each hydrogen or an aliphatic group, or $R^1$ and $R^2$ may together a ring, $R^3$ is a bivalent aliphatic group, X is a bivalent heterocyclic ring having at least one nitrogen, oxygen or sulfur atom as heteroatom, n is 0 or 1, and M is hydrogen or an alkali metal atom, alkaline earth metal atom, a quaternary ammonium, quaternary phosphonium atom or an amidino group, x is 1 or ½ when M is a divalent atom;

said compound optionally being in the form of an addition salt.

6. The material of claim 1 wherein the size of said spectrally sensitized grains and said non-spectrally sensitized grains ranges independently from 0.05 to 1.0 micron in equivalent circle diameter.

7. The material of claim 1 wherein the size of said non-spectrally sensitized grains is smaller than the size of the spectrally sensitized grains.

8. The material of claim 1 wherein both types of grains are chemically sensitized.

9. The material of claims 1 wherein said spectrally sensitized grains are chemically sensitized, and said non-spectrally sensitized grains are not chemically sensitized.

10. The material of claim 1 wherein both types of grains comprise 50 to 90 mol % silver chloride.

* * * * *